US008698729B2

(12) United States Patent
Ward et al.

(10) Patent No.: US 8,698,729 B2
(45) Date of Patent: Apr. 15, 2014

(54) MITIGATION OF LCD FLARE

(75) Inventors: Gregory John Ward, Berkeley, CA (US); James Harrison, Vancouver (CA); Helge Seetzen, Westmount (CA); Matthew Trentacoste, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 509 days.

(21) Appl. No.: 12/811,496

(22) PCT Filed: Jan. 6, 2009

(86) PCT No.: PCT/US2009/030207
§ 371 (c)(1),
(2), (4) Date: Jul. 1, 2010

(87) PCT Pub. No.: WO2009/089211
PCT Pub. Date: Jul. 16, 2009

(65) Prior Publication Data

US 2010/0277515 A1 Nov. 4, 2010

Related U.S. Application Data

(60) Provisional application No. 61/020,104, filed on Jan. 9, 2008.

(51) Int. Cl.
*G09G 3/36* (2006.01)

(52) U.S. Cl.
USPC ..... 345/102; 345/690

(58) Field of Classification Search
None
See application file for complete search history.

(56) References Cited

U.S. PATENT DOCUMENTS

| | | | | |
|---|---|---|---|---|
| 4,816,876 | A | 3/1989 | Pryor | |
| 5,978,142 | A | 11/1999 | Blackham et al. | |
| 6,891,672 | B2 | 5/2005 | Whitehead et al. | |
| 7,692,622 | B2 * | 4/2010 | Kim et al. | 345/102 |
| 8,111,234 | B2 * | 2/2012 | Tokuyasu | 345/102 |
| 2005/0110742 | A1 * | 5/2005 | Arakawa | 345/102 |
| 2005/0237293 | A1 | 10/2005 | Kim | |
| 2006/0103621 | A1 | 5/2006 | Feng | |
| 2006/0125775 | A1 * | 6/2006 | Itoh | 345/102 |
| 2006/0239033 | A1 | 10/2006 | Jung et al. | |
| 2006/0261754 | A1 | 11/2006 | Lee | |
| 2007/0285379 | A1 | 12/2007 | Jung | |
| 2010/0289833 | A1 * | 11/2010 | Budzelaar et al. | 345/690 |

FOREIGN PATENT DOCUMENTS

| | | |
|---|---|---|
| CN | 101086573 | 12/2007 |
| EP | 2058792 | 5/2009 |
| JP | 2005-258403 | 9/2005 |
| JP | 2005-309338 | 11/2005 |

(Continued)

OTHER PUBLICATIONS

Seetzen H et al,"High Dynamic Range Display Systems", Proceedings ACM Siggraph, Dec. 9, 2004, pp. 1-9.

(Continued)

*Primary Examiner* — Andrew L Sniezek

(57) ABSTRACT

Liquid Crystal Display (LCD) flare is reduced by adjusting a backlight to a level where the LCD flare is not visible, and then introducing a simulated veiling glare. The glare is further adjusted by the backlight simulation to hide the geometry (e.g., Light Emitting Diode (LED) array) of the backlight. The reduction is performed, for example, by processing signals for driving the backlight and a front modulator in a dual modulation display device.

42 Claims, 3 Drawing Sheets

(56) References Cited

FOREIGN PATENT DOCUMENTS

| | | | |
|---|---|---|---|
| JP | 2007-240858 | | 9/2007 |
| JP | 2007-322882 | | 12/2007 |
| JP | 2009-116012 | | 5/2009 |
| RU | 2139559 | | 10/1999 |
| RU | 2226708 | | 4/2004 |
| WO | 02/03687 | A2 | 1/2002 |
| WO | 03/077013 | A1 | 9/2003 |
| WO | 2005036870 | A1 | 4/2005 |

OTHER PUBLICATIONS

Feng Li Chester F Carlson Center for Imaging Science et al,"66.1: Distinguished Student Paper: Deriving LED Driving Signal for Area-Adaptive LED Backlight in High Dynamic Range LCD Displays", SID 2007, 2007 SID International Symposium, Society for Information Display, Los Angeles, USA, vol. XXXVIII, May 20, 2007, pp. 1794-1797.

Seetzen H et al,"54.2: A High Dynamic Range Display Using Low and High Resolution Modulators", 2003 SID International Symposium Digest of Technical Papers, Baltimore, MD, May 20-22, 2003, San Jose, CA, USA, vol. XXXIV, No. 1, May 20, 2003, pp. 1450-1453.

Fang-Cheng Lin et al:"39,4: Inverse of Mapping Function (IMF) Method for Image Quality Enhancement of High Dynamic Range LCD TVs", SID 2007, 2007 SID International Symposium, Society for Information Display, Los Angeles, USA, vol. XXXVIII, May 20, 2007, pp. 1343-1345.

Seetzen H et al,"Self-Calibrating Wide Color Gamut High Dynamic Range Display", IS&T/SPIE's Annual Symposium on Electronic Imaging, XX, XX, vol. 6492, 12 Fe. 2007, pp. 649202/I-9.

* cited by examiner

MITIGATION OF LCD FLARE

CROSS-REFERENCE TO RELATED APPLICATIONS

This application claims priority to U.S. Provisional Patent Application No. 61/020,104, filed Jan. 9, 2008, hereby incorporated by reference in its entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to artifact reduction and particularly to reduction of LCD flare. The present invention comprises an improvement to existing process of computing the LCD and LED images.

2. Discussion of Background

Dynamic range is the ratio of intensity of the highest luminance parts of a scene and the lowest luminance parts of a scene. For example, the image projected by a video projection system may have a maximum dynamic range of 300:1.

The human visual system is capable of recognizing features in scenes which have very high dynamic ranges. For example, a person can look into the shadows of an unlit garage on a brightly sunlit day and see details of objects in the shadows even though the luminance in adjacent sunlit areas may be thousands of times greater than the luminance in the shadow parts of the scene. To create a realistic rendering of such a scene can require a display having a dynamic range in excess of 1000:1. The term "high dynamic range" means dynamic ranges of 800:1 or more.

Modern digital imaging systems are capable of capturing and recording digital representations of scenes in which the dynamic range of the scene is preserved. Computer imaging systems are capable of synthesizing images having high dynamic ranges. However, current display technology is not capable of rendering images in a manner which faithfully reproduces high dynamic ranges.

Blackham et al., U.S. Pat. No. 5,978,142 discloses a system for projecting an image onto a screen. The system has first and second light modulators which both modulate light from a light source. Each of the light modulators modulates light from the source at the pixel level. Light modulated by both of the light modulators is projected onto the screen.

Gibbon et al., PCT application No. PCT/US01/21367 discloses a projection system which includes a pre modulator. The pre modulator controls the amount of light incident on a deformable mirror display device. A separate pre-modulator may be used to darken a selected area (e.g. a quadrant).

Whitehead at al., U.S. Pat. No. 6,891,672, and related patents and patent applications describe many techniques, including, among others, the implementation and refinement of dual modulated displays, wherein a modulated backlight (aka local dimming) projects onto a front modulator (e.g., LCD) of a display.

SUMMARY OF THE INVENTION

The present inventors have realized the need for improved processes for computing LCD and LED images. In one embodiment, the present invention provides a display, comprising a front modulator, a backlight configured to produce a modulated light illuminating the front modulator, and a controller configured to process an image signal into a backlight control signal and a front modulator control signal, wherein at least one of the backlight control signal and the front modulator control signal comprises a control signal having an artifact removed and an artificial effect introduced into an image produced by the signals. The artifact may comprise, for example, an LCD flare and the artificial effect may comprise, for example, a veiling glare. The veiling glare is configured, for example, to minimize effects caused by a geometry of the backlight.

In another embodiment, the invention may comprise a display, comprising a front modulator, a backlight configured to produce a modulated light illuminating the front modulator, and a controller configured to produce a backlight control signal and a front modulator control signal from an image signal, wherein at least one of the backlight control signal and the front modulator control signal comprises an adjustment of values that minimize the occurrence of LCD flare. The adjustment of values may comprise, for example, a reduction of visible flare in an image to be displayed, and the introduction of a veiling glare may be configured, for example, to obscure artifacts related to the backlight.

The invention may also be embodied as a method, including a method of driving a dual modulation display, comprising the steps of, determining a flare that would be visible in an output of the display, adjusting drive levels of a backlight so that the flare is reduced, adding a simulated veiling glare, and adjusting a backlight simulation to produce a shape of the veiling glare so as to hide a geometry of the backlight. The backlight may comprise, for example, an LED array and the backlight simulation adjustment hides the geometry of the LED array.

In yet another embodiment, the invention may comprise a method of driving a display comprising a modulated backlight and a front modulator illuminated by the modulated backlight, comprising the steps of, computing a front modulator image and a simulated backlight image from image data, determining locations of at least one LED "skirt," simulating a veiling glare, calculating a backlight suppression image configured to compensate regions where the "skirt" exceeds the simulated glare, re-computing the simulated backlight in light of the backlight suppression image, determining "missing" glare sources, calculating a veiling glare for each missing glare source, and constructing a new LCD image comprising the calculated veiling glares. The front modulator may comprise, for example, an LCD panel, and the backlight may comprise, for example, an LED array. The backlight may comprise any of an RGB, RGBW, or RGB plus an additional color(s) (or white) LED array.

The veiling glare may be simulated, for example, via convolution. The step of identifying regions may comprise, for example, subtracting a convolution image used to produce the simulated glare from an image of the "skirt." The step of suppressing the identified regions may comprise, for example, using a multiplier at each pixel where the "skirt" exceeds a predetermined epsilon of the simulated glare. The step of re-computing may comprise, for example, applying the backlight suppression image to at least part of image data used to create the backlight simulation and then recomputing the backlight simulation.

Portions of both the device and method may be conveniently implemented in programming on a general purpose computer, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The invention comprises an improvement to the existing process of computing the LCD and LED images. Although preferably applied on an HDR display, the principles and features of the invention are also applicable to any dual modulation display where one of the modulators is an LCD panel. The dynamic range of the display can be low, for example any of the currently known modulated backlight LCD panels.

The specific improvement of the invention addresses the issue of illuminating small bright features on a dark surround. In this case, the LCD panel cannot block all light from the backlight (e.g., LEDs) in the dark surround and thus the flare of these LEDs creates a skirt of light that diminishes the intended appearance of the display. Because the feature is small, the perceptual effect of veiling luminance is not sufficient to hide the LED flare. In a modulated backlight using LEDs, as the feature moves across the display, neighboring LEDs are turned on and off as necessary to illuminate the feature, and the flare from these LEDs is visible and thus the geometry of the LED array is exposed to the viewer.

Figure 1:
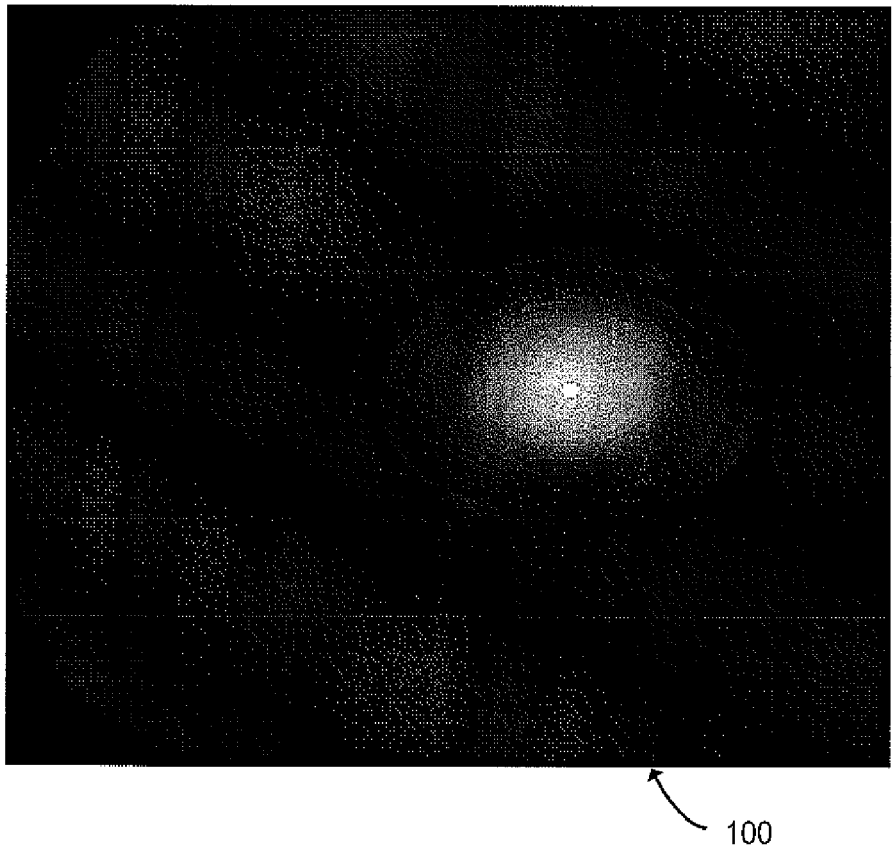
FIG. 1 is an illustration of an LCD flare.

Referring now to the drawings, wherein like reference numerals designate identical or corresponding parts, and more particularly to FIG. 1 thereof, there is illustrated an example of an LCD flare 100. As shown in FIG. 1, the flare 100 is in three basic parts (1) a small white circle with (2) LED flare, and, eventually, (3) a black surround that is intended.

Figure 2:
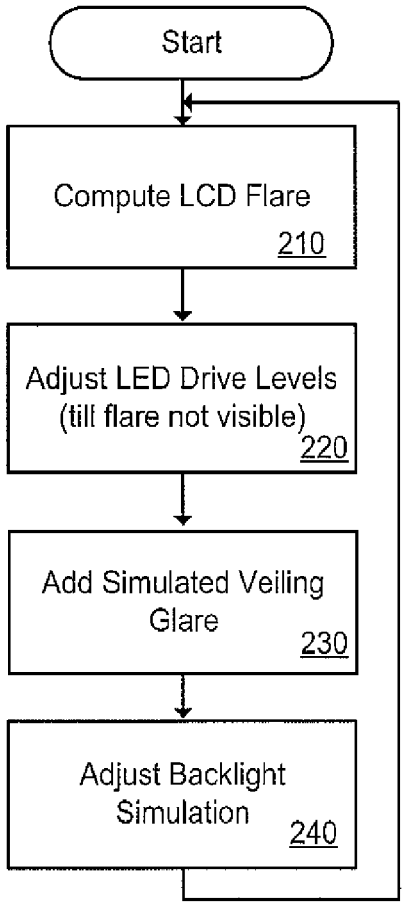
FIG. 2 is flowchart of an embodiment of the present invention.

In one embodiment, the invention is a process that computes where the flare from the LEDs would be visible, adjusting the LED drive levels until the flare should not be visible, and adding additional simulated veiling glare to the image to simulate a bright small feature. The added glare is then adjusted by the LED backlight simulation to produce a stable glare shape that hides the LED array geometry. An exemplary process, that is performed for example in a processor and/or controller of a display is illustrated in FIG. 2, including step 210 a computation of LCD flare, an adjustment of LED drive levels (step 220), the addition of a simulated glare (step 230), and the adjustment of a backlight simulation (step 240).

Relying entirely on the ideal veiling luminance capability of the display is not preferred because HDR displays may have difficulty in achieving their peak brightness for all feature sizes. Instead, small features are quite dim compared to large features. Thus, for small features, the contrast ratio of the LCD panel provides high frequency (spatial) details.

As noted above, current LCDs do not block all light, thus when the LCD is set to black, light from the LED backlight is attenuated but not completely extinguished. Bright LEDs are used to illuminate small bright features (it is not sufficient to have only large bright features, small bright features are required too). Unfortunately, even when the LCD is set to full black, some light comes through.

Thus, when illuminating a small bright feature, such as circle, on a black (dark) background, three regions are generally observed:

- the small bright central feature
- the surrounding skirt (flare, or leakage) of the LEDs under the fully-black portion of the LCD, this includes a "central skirt" located over the strongly driven LEDs, and a "surrounding skirt" formed from the wide Point Spread Function (PSF) of the LEDs.
- the further away black portions of the LCD are illuminated poorly by the LEDs so they appear fully black.

The Walking LEDs problem is magnified by attempts to brightly illuminate small bright features. However, a significant component of the problem is the down-sample scheme used to compute LED drive values from the input image.

In the various implementations of algorithms designed for Blur Correction, the input image is scaled (averaged) with some amount of filtering from the resolution of the LCD to the resolution of the LED Back Light Unit (BLU) array. For example, down sampling scheme can be essentially a box filter (or any other filter that computes LED target values)—such an implementation results in a system where small changes in the input image, such as the movement by one pixel of a small bright feature on black, can cause LED "target values" to jump to or from zero (off).

Using the Brightside DR37-P display processor, it is possible to "over-drive" LEDs to sufficiently illuminate isolated small bright features. The reference implementation in Matlab, and the normal operation of the DR37-P display processor, uses the block average luminance level around an LED to determine the LED drive level. Thus small bright features are typically under illuminated and as larger brighter features move closer to small bright features the small features increase in brightness. This change in brightness is undesirable, and the skirt artifact is an unintentional side effect of attempting to fully illuminate small features.

Following the down sample, the LED drive values are computed by an "exchange" process which attempts to take in to account the amount of light contributed by the neighboring LEDs. The exchange step can be thought of as a sharpening filter which decreases LED drive values in regions of uniformity, and increases drive values at edges or isolated features. Because LED drive values are restricted to the range [0.0, 1.0] it is possible for a single LED to jump between off and fully on from one frame to the next.

In one embodiment, the present invention may be embodied, for example, in the following steps:

1. Compute the LCD1 image and simulated backlight image, $B_1$, using the standard method.
2. Simulate the final HDR display, $D_1$, by taking the minimum LCD transmittance.
3. Subtract the original (scaled) HDR, $H_0$, from the simulated display to locate the LED "skirts." Call this image $L_1$.
4. Simulate veiling glare associated with a "perfect" display of the input image using the veiling glare convolution formula below. Call this image $G_1$. Use +/−3 LEDs for the size of the glare filter.

5. Determine where the LED skirt needs to be suppressed by identifying regions where skirt exceeds glare. This can be done by subtracting the above convolution image $G_1$ from the LED skirt image $L_1$ computed in (3) and if the value exceeds some small epsilon (I used 0.0005), then use a multiplier of veil/skirt at this pixel. For other pixels, use 1.0 (unity scaling). Since it's the actual LED values that need suppression, we downsample the resulting image to the backlight hex grid resolution using a min function (e.g., a Gaussian kernel). Call this backlight suppression image $R_b$.
6. After applying the above scaling $R_b$ to the LEDs, recompute the simulated backlight image as in (1) using the adjusted backlight control values. Call this $B_2$.
7. Compute "missing" glare sources in the adjusted display by subtracting a new display simulation $D_2$ from the original (scaled) HDR input $H_0$. Set negative values in the difference image to zero. Call this $S_m$.
8. Use the above sources $S_m$ in the convolution formula from (4) to determine the missing flare that the viewer should experience, but won't because our bright point(s) are now too dim. Call this missing flare $G_m$.
9. Add the computed "missing flare" to the original input HDR values to arrive at a new target image, $H_0+G_m$. Use this target to compute the actual foreground pixel values for the LCD2 image output with the backlight image $B_2$.

The result is a display with simulated flare in regions where viewers should have experienced real flare, sufficient to mask remaining LED skirts.

Representations:

$B_1$=physical units
LCD1 image=normalized units
$D_1$=physical units
$H_0$=physical units (originally normalized units)
$L_1$=physical units
$G_1$=physical units
$L_1$-$G_1$=physical units
$R_b$=normalized units
$B_2$=physical units
$D_2$=physical units
$S_m$=physical units
$G_m$=physical units
$H_0+G_m$=physical units
LCD2 image=normalized units The most expensive parts of this computation are in steps 4 and 8 where the veiling glare of the display is calculated. Rather than use a relatively large glare filter at the full resolution of the LCD panel, separate the glare filter into a low frequency and a high frequency components and apply the low frequency component to a down sampled image, then upscale the result
apply the high frequency component to the original image
add the two results together The next most expensive parts of this computation are in steps 1 and 6 where the backlight is simulated. One option is to use the results of step 1 and only adjust it where in step 6 LEDs have changed in value by a significant amount (or any amount). This restricts light field simulation computation for LED values that change, rather than for all LEDs of the display. However, enough processing power should be provided to compute the entire backlight for any frame of input.

Finally, rather than compute the initial LCD1 and B1 in step 1 using the standard method, one alternative is to start with a large error (e.g., turning on all/or many LEDs) and letting the algorithm dampen them down (steps 2-9).

The mitigation algorithm is very likely to be sensitive to the down sample algorithm used to initially set the value of the LEDs. Analysis of the performance of the algorithm versus various down sample schemes shows that LEDs will still make sudden transitions from off to on to off given a down sample scheme that is extremely sensitive to the position of the small bright features in an image.

Critical parameters are the veiling luminance function (although this is approximately the same function for a very wide class of observers and is not tied to a specific display).

A mitigation technique implementing the present invention includes a process for solving the problem of illuminating a small bright feature on black surround. The process first reviews/determines a predicted veiling glare for image features, and suppresses LED skirts that exceed it.

The process then adds in a simulation of the flare that should be present from the missing stimulus. The process has an added benefit of simulating sources much brighter than could normally be represented, such as the sun or other intense highlights.

An exemplary mitigation technique according to the invention comprises the steps of:

(1) Computing LED drive values, computing a simulated backlight image, and computing the LCD image.
(2) Simulating a final HDR display by taking a minimum LCD transmittance.
(3) Subtracting the original (scaled) HDR from the simulated display to locate the LED "skirts."
(4) Simulating a veiling glare associated with a "perfect" display of the input image using a convolution kernel.
(5) Determining where the LED skirt needs to be suppressed by identifying regions where the skirt exceeds glare. Identifying regions where skirt exceeds glare can be performed by subtracting the convolution image from the LED skirt image computed in (3) and if the value exceeds an epsilon (e.g., 0.0005), then use a multiplier of veil/skirt at this pixel. For other pixels, use, for example, a unity scaling (1.0). Since it is the actual LED values that need suppression, we downsample the resulting image to the backlight hex grid resolution. The downsampling may be performed, for example, using the same downsampling function used to compute LED drive values in step (1) (e.g., a min function (ideally), a Gaussian kernel, or the like).
(6) Re-computing the simulated backlight image as in (1) using the adjusted backlight control values.
(7) Computing "missing" glare sources in the adjusted display by subtracting a new display simulation from the original (scaled) HDR input. Set negative values in the difference image to zero.
(8) Using the above sources in the convolution formula from (4) to determine the missing flare that the viewer should experience, but won't because the bright point(s) are now too dim.
(9) Adding the computed "missing" flare to the original input HDR values to arrive at a new target image. Using this target to compute the actual foreground pixel values for the LCD output.

The convolution kernel of step (4) may be expressed, for example, as:

```
for angle = [0:degreesPerPixel:max_angle]
    if angle < 0.5
        mag(index) = 9.2 / (0.5^2);
```

-continued

```
            else
                mag(index) = 9.2/ (angle^2);
            end
        index++
    end
```

Another possible convolution would be similar to:

Convolve[t=0,max_theta]((1.58724464>>t)?
9.2/((t>0.00291)?t:0.00291)^3.44:
9.2*(1.5+t)/t));

Eccentricity (angle) is expressed in degrees from each pixel, which is calculated based on an expected viewing distance. Max angle is typically between approximately 1 and 4 LED spacings and based on viewing distance, and is set, for example, to 7 degrees, or where the convolution formula drops to less than ½ of a percent of its maximum at angle=0.

The result of the process is a display with simulated flare in regions where viewers should have experienced real flare, sufficient to mask remaining LED skirts.

Figure 3:
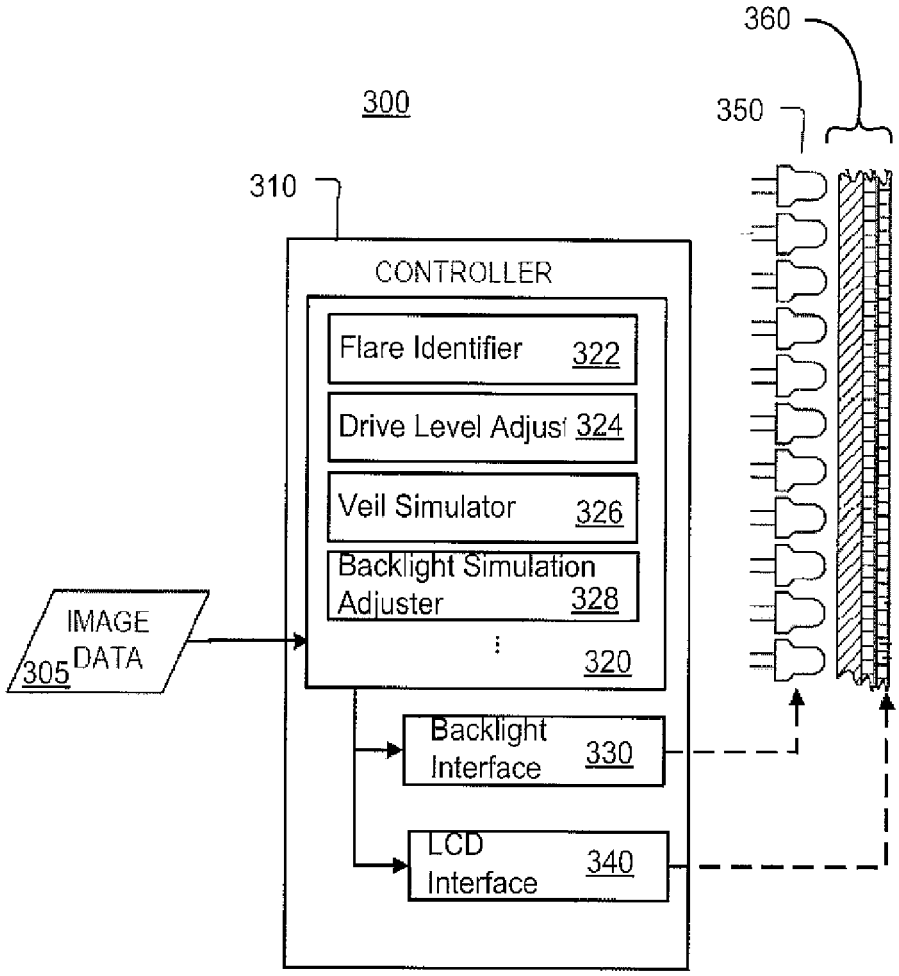
FIG. 3 is a diagram illustrating an implementation of an embodiment of the present invention.

The processes or techniques described above may, for example, be implemented in a dual modulation display that comprises, for example, a structure 300 as illustrated in FIG. 3. Image data 305 is input to a controller 310, and processed according to the controller, including processor 320 which includes a flare identifier 322, a drive level adjuster 324, a veil simulator 326, and a backlight simulation adjuster 328, each configured according to one or more of the above described processes/techniques.

A backlight interface 33C provides data for driving an LED array 350, and an LCD interface is configured to drive an LCD of a front panel 360. The LED array 330 and LCD of front panel 360 provide dual modulation as computed/adjusted according to one or more of the above described processes techniques.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner. For example, when describing an LED BLU, any other equivalent device, such as laser or silicon based light arrays, silicon reflective arrays (e.g., LCoS), laser on DLP, e-paper, organic light sources (e.g., OLED), or other light source devices having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to dual modulation display systems, samplers, filters, LCDs, LEDs, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/−, micro-drive, and magneto-optical disks, ROMs, RAMS, EPROMs, EEPROMs, DRAMs, VRAMs, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, computing/simulating image backlights and final displays, computations for identifying, adding, subtracting, convolving, and comparing any of images, image features, aberrations, flares, glares, skirts, veils and the display, storage, or communication of results according to the processes of the present invention.

The present invention may suitably comprise, consist of, or consist essentially of, any of element, part, or feature of the invention and their equivalents. Further, the present invention illustratively disclosed herein may be practiced in the absence of any element; whether or not specifically disclosed herein. Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A method of driving a dual modulation display, comprising the steps of:

determining a flare that would be visible in an image at an output of the display;

adjusting drive levels of a backlight so that the flare is reduced;

adding a simulated veiling glare to the image data; and adjusting a backlight simulation to produce a shape of the veiling glare so as to hide a geometry of the backlight.

2. The method according to claim 1, wherein the backlight comprises a Light Emitting Diode (LED) array and the backlight simulation adjustment hides the geometry of the LED array.

3. The method according to claim 1, wherein the step of adding a simulated veiling glare to the image comprises applying high frequency components of the simulated veiling glare to image data to produce a high frequency version of the veiling glare in image data, applying low frequency components of the simulated veiling glare to a downsampled version of the image data and then upsampling to produce a low frequency version of the veiling glare in image data, and applying the high and low frequency versions to the output of the display.

4. The method according to claim 1, wherein the veiling glare is based on a convolution kernel.

5. The method according to claim 4, wherein the convolution kernel is optimized based on an expected viewing distance and a viewing angle in a range of between 1 and 4 lighting elements of a first modulation system of the dual modulation display.

6. The display according to claim 4, wherein the convolution kernel is based on a range of viewing angles and produces values that drop to less than ½ of a percent of a maximum value at a 0 degree viewing angle.

7. The method according to claim 1, wherein the method is performed on HDR image data and the dual modulation display produces High Dynamic Range (HDR) images having a contrast ratio in excess of 1000:1.

8. The method according to claim 1, wherein the veiling glare comprises a stable glare.

9. The method according to claim 1, wherein the backlight comprises at least one of a micro-mirror and Digital Light Processor (DLP) projection device.

10. The method according to claim 1, wherein the backlight comprises an array of laser lighting elements projected onto a modulator.

11. The method according to claim 1, wherein the backlight comprises a laser illuminating a Digital Light Processor (DLP) device.

12. The method according to claim 1, further comprising the step of producing the veiling glare via a convolution comprising an image area comprising a small bright feature.

13. The method according to claim 12, wherein the convolution is bounded by a predetermined number of lighting elements surrounding the small bright feature.

14. A method of driving a display comprising a modulated backlight and a front modulator illuminated by the modulated backlight, comprising the steps of:

computing a front modulator image and a simulated backlight image from image data;

determining locations of at least one backlight skirt that would appear on the front modulator if the computed front modulator image and simulated backlight image were utilized to energize the display;

simulating a veiling glare corresponding to a feature in the image data associated with said skirt;

calculating a backlight suppression image configured to compensate regions where the skirt exceeds the simulated glare;

re-computing the simulated backlight in light of the backlight suppression image;

determining glare locations in an output of the display;

calculating a veiling glare for each glare location; and constructing a new front modulator image comprising the calculated veiling glares.

15. The method according to claim 14, wherein the front modulator comprises a Liquid Crystal Display (LCD) panel.

16. The method according to claim 14, wherein the veiling glare is simulated via convolution.

17. The method according to claim 16, wherein the convolution comprises a process comprising:

```
for a viewing angle = [0:degreesPerPixel:max_angle]
  if angle < 0.5 mag(index) = 9.2 / (0.5 ^ 2);
  else mag(index) = 9.2/ (angle ^ 2); end index++ end.
```

18. The method according to claim 16, wherein the convolution comprises:

Convolve[t=0,max_theta]((1.58724464>t)?
9.2/((t>0.00291)?t:0.00291)^3.44:
9.2*(1.5+t)/t));

wherein t is a variable between 0 and max-theta; ? is a ternary operator; and * represents multiplication.

19. The method according to claim 14, wherein the step of determining locations comprises subtracting a convolution image used to produce the simulated glare from an image of the skirt.

20. The method according to claim 14, wherein the step of calculating a backlight suppression image comprises using a multiplier at each pixel where the skirt exceeds the simulated glare by a predetermined value.

21. The method according to claim 14, wherein the step of re-computing comprises applying the backlight suppression image to at least part of image data used to create the backlight simulation and then re-computing the backlight simulation.

22. The method according to claim 14, wherein: the method is embodied in a set of computer instructions stored on a computer readable media; said computer instructions, when loaded into a computer, cause the computer to perform the steps of the method.

23. The method according to claim 22, wherein said computer instruction are compiled computer instructions stored as an executable program on said computer readable media.

24. A non-transitory computer readable media and a set of instructions stored by the computer readable media that, when loaded into a computer, cause the computer to perform the steps of:

determining a flare that would be visible in an image at an output of a display;

adjusting drive levels of a backlight of the display so that the flare would be reduced; and adding a simulated veiling glare to the image;

wherein the steps further comprise adjusting a backlight of the display to produce a shape of the veiling glare that reduces visibility of a geometry of the backlight.

25. A display, comprising:

a front modulator;

a backlight configured to produce a modulated light illuminating the front modulator; and a controller configured to produce a backlight control signal and a front modulator control signal from an image signal;

wherein at least one of the backlight control signal and the front modulator control signal are adjusted to minimize front modulator flare that occurs due to excess illumination in an area corresponding to an area of an image to be displayed comprising a bright feature and introduce a simulated glare in the image;

wherein at least one of the adjusted backlight control signal and the front modulator signal results in a reduction of flare that would otherwise be visible in an image to be displayed, and the simulated glare comprises introduction of a veiling glare in the image to be displayed; and wherein the veiling glare is configured to obscure artifacts related to a geometry of the backlight.

26. The display according to claim 25, wherein the backlight comprises a plurality of Light Emitting Diodes (LEDs).

27. The display according to claim 25, wherein the backlight comprises a laser illuminating a Digital Light Processing (DLP) device.

28. The display according to claim 25, wherein the adjusted control signal comprises a control signal having an artificial veiling glare added to a control signal comprising a desired image, and the veiling glare comprises a convolution of an area of the desired image comprising a bright feature on a darker background.

29. The display according to claim 25, wherein the backlight comprises at least one of a plurality of Light Emitting Diodes (LEDs), a laser, and a Digital Light Processor (DLP) device.

30. A display, comprising:

a front modulator;

a backlight configured to produce a modulated light illuminating the front modulator; and a controller configured to process an image signal into a backlight control signal and a front modulator control signal;

wherein at least one of the backlight control signal and the front modulator control signal comprises a control signal having an artifact removed and an artificial effect introduced into an image produced by the signals;

wherein the artifact comprises a Liquid Crystal Display (LCD) flare and the artificial effect comprises a veiling glare; and wherein the veiling glare is configured to minimize effects caused by a geometry of the backlight.

31. The display according to claim 30, wherein the artificial effect comprises a veiling glare.

32. The display according to claim 30, wherein the backlight comprises at least one of a plurality of Light Emitting Diodes (LEDs), a laser, and a Digital Light Processor (DLP) device.

33. The display according to claim 30, wherein the backlight comprises a laser and a micro-mirror based device.

34. The display according to claim 30, wherein the backlight comprises a laser on Digital Light Processor (DLP) device.

35. The display according to claim 30, wherein the artificial effect comprises a convolution of an area of a desired image surrounding a bright spot and the backlight comprises a first modulator in a dual modulation projection system comprising at least one of a plurality of Light Emitting Diodes (LEDs), a laser, and a Digital Light Processor (DLP) device.

36. A method of driving a dual modulation device configured to project an image to be viewed by a viewer, comprising the steps of:

calculating first drive signal based on image data of a desired image for a first modulation system configured to produce a first modulated light;

calculating a second drive signal based on the image data for a second modulation system producing a backlight configured to further modulate the first modulated light in a manner to produce the image to be viewed by the viewer;

wherein at least one of the first drive signal and the second drive signal comprise modulation signals that are adjusted so as to remove a skirt effect around bright objects in relatively dark areas of the image to be viewed by the viewer and add an artificial glare to the image to be viewed by the viewer; and wherein a shape of the artificial glare minimizes visibility of a geometry of the backlight.

37. The method according to claim 36, wherein the artificial glare comprises a simulated veiling glare comprising a stable glare shape.

38. The method according to claim 36, wherein the first drive signal comprises a signal configured to control a laser based light array.

39. A display, comprising:

a front modulator;

a backlight configured to produce a modulated light illuminating the front modulator; and a controller configured to process an image signal into a backlight control signal and a front modulator control signal;

wherein at least one of the backlight control signal and the front modulator control signal comprises a control signal having an artifact removed and an artificial effect introduced into an image produced by the signals; and wherein the artificial effect comprises a convolution of an area of a desired image surrounding a bright spot.

40. The display according to claim 36, wherein the convolved area of the image comprises an area corresponding to an area of 1 to 4 lighting elements of the backlight.

41. The display according to claim 39, wherein the convolution is used to produce a veiling glare in image data representing at least part of a desired image.

42. The display according to claim 39, wherein the convolution comprises an operation whose value drops to less than ½ of a percent of its maximum at angle=0.

* * * * *